US009937934B2

(12) United States Patent
Kontetzki

(10) Patent No.: US 9,937,934 B2
(45) Date of Patent: Apr. 10, 2018

(54) COUPLING HEAD OF A CENTRAL BUFFER COUPLING

(71) Applicant: VOITH PATENT GMBH, Heidenheim (DE)

(72) Inventor: Arthur Kontetzki, Salzgitter (DE)

(73) Assignee: Voith Patent GmbH, Heidenheim (DE)

( * ) Notice: Subject to any disclaimer, the term of this patent is extended or adjusted under 35 U.S.C. 154(b) by 111 days.

(21) Appl. No.: 15/021,355

(22) PCT Filed: Sep. 11, 2014

(86) PCT No.: PCT/EP2014/069397

§ 371 (c)(1),
(2) Date: Mar. 11, 2016

(87) PCT Pub. No.: WO2015/036482

PCT Pub. Date: Mar. 19, 2015

(65) Prior Publication Data

US 2016/0221590 A1 Aug. 4, 2016

(30) Foreign Application Priority Data

Sep. 11, 2013 (DE) ..... 10 2013 218 156

(51) Int. Cl.
*B61G 7/06* (2006.01)
*B61G 3/16* (2006.01)

(52) U.S. Cl.
CPC *B61G 7/06* (2013.01); *B61G 3/16* (2013.01)

(58) Field of Classification Search
CPC ... B61G 7/00; B61G 7/06; B61G 7/08; B61G 3/16
See application file for complete search history.

(56) References Cited

U.S. PATENT DOCUMENTS 7,604,136 B2 * 10/2009 Kontetzki ..... B61G 3/16 213/75 R
2007/0187350 A1 * 8/2007 Kontetzki ..... B61G 7/00 213/75 R (Continued)

FOREIGN PATENT DOCUMENTS

AU 2012202464 A1 11/2012
DE 1124535 B 3/1962

(Continued)

*Primary Examiner* — Jason C Smith
(74) *Attorney, Agent, or Firm* — Laurence A. Greenberg; Werner H. Stemer; Ralph E. Locher

(57) ABSTRACT

A coupling head for a central buffer coupling for vehicles that are able to be coupled has a coupling head housing and an end plate that terminates the coupling head housing on the end face and is releasably connected to the coupling head housing. The coupling head housing has a first connection region for coupling to the end plate and a second connection region for establishing the connection to a coupling rod. The coupling head housing is designed in one piece as a forged component. The first connection region is formed on the coupling head housing by at least two contact surfaces arranged separately from one another in order to be at least indirectly supported on partial surfaces of the end plate and the coupling head housing is connected to the end plate in the first connection region by non-positive connections.

15 Claims, 1 Drawing Sheet

(56) References Cited

U.S. PATENT DOCUMENTS

| | | | | |
|---|---|---|---|---|
| 2016/0221590 | A1* | 8/2016 | Kontetzki | B61G 7/06 |
| 2016/0272224 | A1* | 9/2016 | Beck | B61G 7/10 |

FOREIGN PATENT DOCUMENTS

| | | | |
|---|---|---|---|
| EP | 1805073 | A1 | 7/2007 |
| EP | 2522560 | A1 | 11/2012 |
| WO | 2006027196 | A1 | 3/2006 |

* cited by examiner

FIG. 1
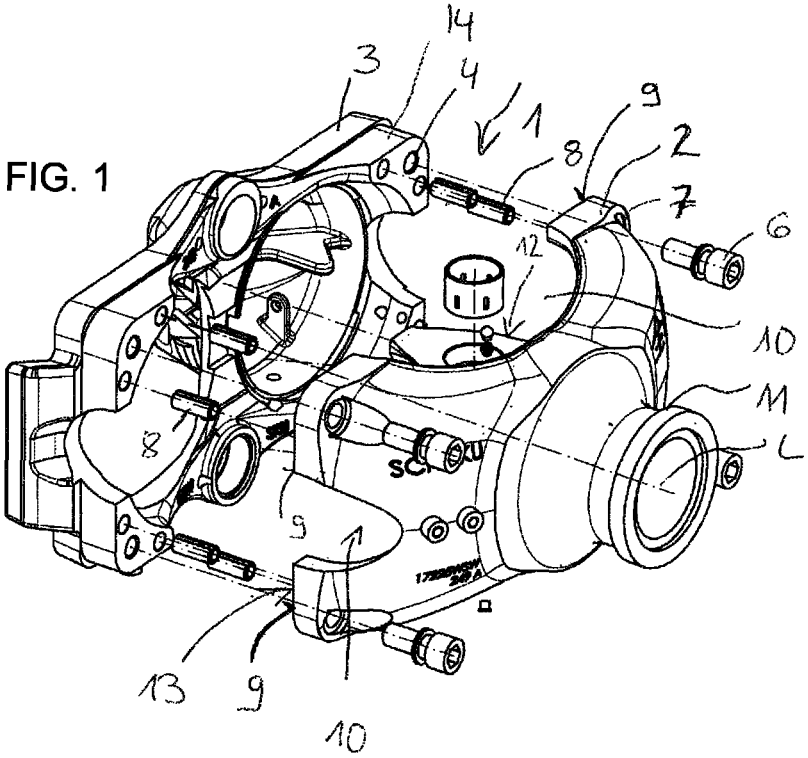
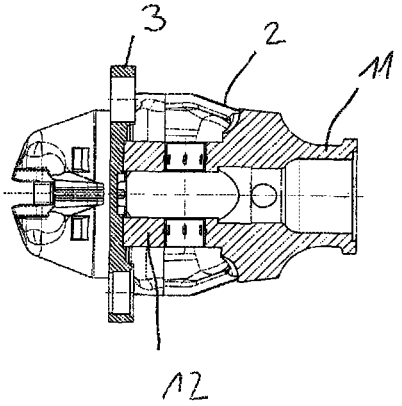
FIG. 2

COUPLING HEAD OF A CENTRAL BUFFER COUPLING

BACKGROUND OF THE INVENTION

Field of the Invention

The invention relates to a coupling head for vehicles which are able to be coupled, in particular rail-bound vehicles comprising a coupling head housing and comprising an end plate which terminates the coupling head housing on the end face, wherein the coupling head housing and the end plate are releasably connected together.

Coupling head housings for vehicles which are able to be coupled are described on a number of occasions in technical and patent documents and, therefore, are known in different embodiments.

The publication DE 11 245 35 B discloses, for example, a housing of a central buffer coupling which is independently rigid, consisting of an end plate having a pyramidal projection or a corresponding recess of a buffer surface on an end piece for connecting the housing to a coupling rod and a coupling head housing located between the end plate and the end piece. The coupling head housing is made up of individual molded parts in a cellular structure. The housing body consists of four molded parts and namely of two similar central parts which represent the upper and lower walls of the housing body and two similar side parts, wherein the central parts and the side parts in each case oppose one another mirror-symmetrically. The central parts are configured as stamped forged parts and the side parts as stamped sheet metal parts.

In contrast, a central buffer coupling of modular construction is disclosed in EP 1 805 073 B1. This consists of a coupling head for vehicles which are able to be coupled having a coupling head housing. An end plate is arranged so as to be adjoined to the coupling head housing on the end face. There is also the possibility of mounting different end plates on different coupling heads.

The coupling head housing is generally of funnel-shaped configuration and on the side opposing the end plate has a connection region, for example an end piece, which is suitable for receiving a coupling rod. The coupling rod in turn is arranged displaceably and/or pivotably on the vehicle, in the vertical and lateral directions, so that the funnel-shaped design is able to receive the mating piece with corresponding tolerances. The coupling head housing has a first connection region for fixing the end plate and a second connection region, in particular a coupling element, for receiving the coupling rod. The actual coupling member is arranged within the coupling head housing for producing a fixed and releasable connection with another coupling member. This coupling member is fixedly connected to the coupling housing. Generally the coupling head housing is a cast part, the coupling members and/or coupling mechanism being arranged thereon.

The majority of previously known designs of central buffer couplings and coupling head housings are constructed and/or manufactured as a complete structural unit. The coupling head housing in this case is connected to the end plate in a planar manner by a plurality of screw connections. In order to compensate for the corresponding spacing, depending on the type of construction, it is provided to arrange between the coupling head housing and the end plate a further spacer element in the form of a plate. A plurality of screw connections ensure a reliable connection between the coupling head housing and the end plate.

Due to the design of the coupling head housing the production is costly. Firstly, during production care already has to be taken that cavities are avoided. In order to ensure the quality, corresponding quality control measures are required after manufacture. Thus, for example, a corresponding crack test by means of fluorescent materials is required, or even an x-ray test. The production time for a coupling head housing made of cast material is lengthy and also requires corresponding additional post-treatment. In particular, the post-treatment has to take place on the coupling elements, namely firstly toward the end face and secondly to the side of the coupling rod.

Due to the fact that the coupling head housing is constructed such that it has to absorb both compressive and tensile forces, which are in the region of 1000 to 1500 kN, the corresponding dimensioning of the wall thicknesses and also the geometry have to be specifically provided therefor. The coupling head housing is subjected to both compressive and tensile forces.

BRIEF SUMMARY OF THE INVENTION

The object of the invention is to configure a coupling head housing for a central buffer coupling such that, in addition to reducing the overall length, simple mounting is possible.

The solution according to the invention is characterized by the features as claimed. Advantageous embodiments are disclosed in the dependent claims.

The object is achieved by the coupling head housing, viewed in the longitudinal direction, having connection regions at the respective opposingly arranged end regions, namely a first connection region for establishing the connection to an end plate and a further connection region for connecting to a coupling rod, wherein the coupling head housing is designed in one piece as a forged component and the first connection region is formed on the coupling head housing by at least two contact surfaces arranged separately from one another in order to be at least indirectly supported on partial surfaces of the end plate and the coupling head housing is connected to the end plate in the first connection region by means of connections, preferably non-positive connections.

In a particularly advantageous embodiment, the first connection region is formed by at least four finger-like projections or pairs of fork-like projections configured on the coupling head housing and comprising the contact surfaces.

The basic idea of the invention is to design a coupling head housing in a more simple manner, such that said coupling head housing is firstly able to be mounted in a more simple manner but secondly said coupling head housing is also able to be produced in a more simple manner. This is achieved by the coupling head housing being of different construction compared to the prior art. Proceeding from a forged component, said forged component has at least two, preferably at least four, contact surfaces which are separated from one another in the manner of fingers and which are releasably connected to the end plate via bolt connections. As a result, defined and above all locally limited force introduction regions are predetermined, said force introduction regions permitting a locally limited introduction of force into the coupling head housing.

As the coupling head housing is a forged component, the lines of force within the coupling head housing are uniform and thus may be optimally diverted via the coupling head housing in the direction of the coupling rod.

In contrast to a cast production, the production time of a forged component is shorter. This is because complex quality control processes such as x-rays, cavity testing or the like are dispensed with. Additionally, the post-treatment processes are shorter, in particular in the regions in which further elements are coupled. An even shorter production time is achieved in that, in particular for connecting to the end plate, the coupling head housing does not bear flat against said end plate, but bears thereagainst at regular intervals in a finger-like manner, namely in particular in defined locally limited regions, particularly preferably in four regions. The remaining end face of the coupling head housing facing the end plate in the mounted state is spaced apart from the end plate and is not in contact therewith. Due to the fact that a bearing takes place on the end plate at regular intervals and within the coupling head housing the coupling elements are arranged such that the forces thereof are diverted directly at the end piece to the coupling rod, the load paths and directions in the coupling head housing are separated. This means that corresponding compressive forces are diverted via the bearing points and/or bearing regions which are in contact with the end plate, whereas the tensile forces are directly conducted via the coupling members and the coupling element. Due to this force distribution the coupling head housing may also be dimensioned differently and more simply.

Due to this dimensioning, however, there is also the advantage that the total overall length of the coupling head housing together with the end plate is considerably shorter in comparison with the prior art.

In a particularly advantageous development, the contact surfaces of the first connection region are arranged on both sides of a plane, the position thereof being able to be described by a longitudinal axis extending in the longitudinal direction of the coupling head and a line perpendicular thereto. Preferably, the arrangement is symmetrical. This configuration permits simple production.

The connection between the coupling head housing and the end plate takes place either directly or by the interposition of compensating elements. In the last-mentioned case the coupling head housing is supported via the compensating elements on the end plate. As a result, the coupling play and production tolerances may be compensated.

The compensating elements may be individual elements or a plate-like element which is adapted on an end face to the contour of the end plate.

The individual non-positive connection is designed as a bolt connection or screw connection.

In a particularly advantageous development, at least one centering device is provided for centering the coupling head housing and optionally the end plate and/or the at least one compensating element. As a result, the assignment and mounting thereof are considerably simplified.

In the simplest case, the at least one centering device comprises pin-like elements which are arranged so as to engage in the opposing components—the coupling head and compensating element and/or end plate. In this case, the individual pin-like element may be configured in one piece with one of the opposingly arranged components or connected thereto.

Preferably, in addition to the coupling head housing, the end plate is also designed as a forged component.

The second connection region on the side opposing the end plate on the coupling head housing is preferably formed by an end piece which is configured integrally with the coupling head housing and which is able to be coupled to a coupling rod.

Coupling members are received in the coupling head housing, said coupling members preferably being configured, at least in part, in one piece with the coupling head housing.

Further advantageous embodiments of the invention are disclosed from the following description, the claims and the drawings, in which:

BRIEF DESCRIPTION OF THE SEVERAL VIEWS OF THE DRAWING

FIG. 1 shows a perspective view of the embodiment according to the invention of the coupling head of a central buffer coupling in an exploded view;

FIG. 2 shows a mounted coupling head.

DESCRIPTION OF THE INVENTION

In FIG. 1 a coupling head 1 which is a component of a central buffer coupling for vehicles, in particular railed vehicles, is shown in an exploded view. The coupling head 1 consists of a coupling head housing 2 and an end plate 3 which is able to be connected on the end face to the coupling head housing 2. Between the coupling head housing 2 and the end plate 3, but not shown in this case, at least one compensating element may be provided for compensating for coupling play and production tolerances. The compensating element may be designed as a spacer plate.

The coupling head housing 2 and the end plate 3 are connected together via at least one non-positive releasable connection, which are preferably designed as bolt connections 5. The bolt connections 5 provide that screws 6, which are passed through bores 7 which are provided locally on the coupling head housing 2, are used and cooperate in either a spacer plate, not shown here, or threads 4 provided at least in the end plate 3 (not shown in more detail in the drawings). As a result, a releasable connection is achieved between the coupling head housing 2 and the end plate 3.

The connection between the end plate 3 and the coupling head housing 2 takes place via a first connection region 13 of the coupling head housing 2. The arrangement of the connecting elements and/or means takes place within the first connection region 13.

In order to permit a simple mounting and positionally correct fixing of the coupling head housing 2 relative to the end plate 3, centering bolts 8 are provided, said centering bolts being optionally arranged either on the side of the end plate 3 or on the side of the coupling head housing 2. When bringing together the coupling head housing 2 and the end plate 3, said elements penetrate the opposing component and thus achieve a central positionally correct arrangement of the coupling head housing 2 relative to the end plate 3. To this end, the centering bolts 8 may be inserted on one of the components—the coupling head housing 2 or end plate 3.

The coupling head housing 2 is configured such that it preferably has four contact surfaces 9 (three thereof being visible in the drawings) on its side facing the end plate 3. The contact surfaces 9 are provided such that they are supported on only one part of the end plate 3, whereas the remaining part is provided with a recess 10. The individual contact surfaces 9 are thus designed to be separate from one another and in the connecting plane designed to be free from a connection to one another. This means that the coupling head housing 2 is supported in a finger-like manner on four regions on the end plate 3 and correspondingly connected there. The remaining recesses are preferably designed to be semi-circular. This is firstly required by the construction as it is a forged component in the present case but it is also required by the non-positive connection, wherein the force is transmitted from the end plate 3 to the coupling head housing 2 via the finger-like contact surfaces and correspondingly conducted to the second connection region 11 which may be designed as a coupling element and which is arranged on the side opposing the end plate 3.

A coupling rod, not shown in the drawings, is adjoined to this further coupling element, said coupling rod in turn being connected to the vehicle, at least in the manner of a joint.

The coupling members 12 required for the coupling process are arranged within the coupling head housing 2. The coupling member 12 provided here is directly arranged in the region of the second connection region 11, so that the tensile force produced by the coupling member 12 may act directly on the connection region 11 and thus on the coupling rod.

The coupling head housing 2 itself is not loaded or only slightly loaded by the tensile loading on the coupling member 12. Due to the finger-like design and the corresponding contact surfaces 9 a large overall depth of the coupling head housing 2 is not necessary, which is why the whole coupling head 1 in its dimensions is designed to be smaller in comparison with the prior art.

Due to the reconstruction of the coupling head housing 2 as a forged component and the reduction to individual, in particular four, contact surfaces, which are correspondingly connected to the end plate 3, a very compact coupling head 1 is produced which is reduced in the overall length of the component and is particularly suitable for specific commercial markets.

The coupling head housing 2 is designed in the manner of a half-shell with four recesses 10 open on the edge, in particular openings, which form the four projections provided for forming the connection region 13. The projections forming the connection region 13 are thus designed to extend in a fork-like and/or finger-like manner on the coupling head housing. The projections run together in the direction of the second connection region 11 and/or are coupled together in the region of the second connection region. The contact surfaces 9 are thus separated from one another and/or arranged locally separate in the connecting plane. The contact surfaces are arranged outside the region of introduction of the forces transmitted by the coupling members. To this end, the contact surfaces 9 are preferably arranged on both sides of the coupling members 12. The arrangement is implemented relative to a theoretical longitudinal axis L which coincides with the coupling axis, preferably symmetrically relative to a plane which is formed by the coupling longitudinal axis and a line perpendicular thereto. The forces introduced via the contact surfaces are applied on the coupling head housing 2 in the second connection region 11.

The support of the contact surfaces 9 of the coupling head housing 2 on the end plate 3 takes place on partial surfaces 14 which are preferably also configured as separate surfaces, i.e. arranged locally separate from one another on the end plate 3.

The coupling members 12 may be configured in one piece with the coupling head housing 2 or connected thereto.

LIST OF REFERENCE NUMERALS

1 Coupling head
2 Coupling head housing
3 End plate
4 Thread
5 Connection, bolt connection
6 Screws
7 Bores
8 Centering bolts
9 Contact surfaces
10 Recess
11 Coupling element
12 Coupling member
13 First connection region
14 Partial surfaces

The invention claimed is:

1. A coupling head for a central buffer coupling for vehicles which are able to be coupled, the coupling head comprising:

a coupling head housing being a forged component formed in one piece and having an end face;

an end plate releasably connected to said coupling head housing and terminating said coupling head housing on said end face;

said coupling head housing having a first connection region for coupling to said end plate and a second connection region for establishing a connection to a coupling rod;

said first connection region being formed on said coupling head housing by at least two contact surfaces arranged separately from one another and defining locally limited force introduction regions, said at least two contact surfaces being configured to be supported on partial surfaces of said end plate; and said coupling head housing being connected to said end plate in said first connection region.

2. The coupling head according to claim 1, wherein said at least two contact surfaces of said coupling head are connected to said partial surfaces of said end plate by non-positive connections.

3. The coupling head according to claim 1, wherein said first connection region is formed by at least four finger-shaped or fork-shaped projections configured on said coupling head housing and comprising said contact surfaces.

4. The coupling head according to claim 1, wherein said contact surfaces of said first connection region are arranged on both sides of a plane described by a longitudinal axis extending in a longitudinal direction of said coupling head and a line perpendicular to the longitudinal axis.

5. The coupling head according to claim 1, wherein the individual connection between the coupling head housing and the end plate is designed as a non-positive connection and is formed by a bolt connection or screw connection.

6. The coupling head according to claim 1, wherein said at least two contact surfaces of said coupling head housing are directly supported on the partial surfaces of said end plate.

7. The coupling head according to claim 1, which comprises at least one compensating element arranged between said end plate and said coupling head housing, and wherein said coupling head housing is supported on said contact surfaces via said at least one compensating element on said end plate.

8. The coupling head according to claim 7, which comprises at least one centering device for centering said coupling head housing and said end plate and/or said at least one compensating element.

9. The coupling head according to claim 8, wherein said at least one centering device comprises pin-shaped elements which are arranged so as to engage in respectively opposing components, namely, said coupling head housing and said compensating element and/or said end plate.

10. The coupling head according to claim 9, wherein each individual said pin-shaped element is configured in one piece with one of the opposing components or is connected thereto.

11. The coupling head according to claim 1, which comprises at least one centering device for centering said coupling head housing and said end plate.

12. The coupling head according to claim 1, wherein said end plate is a forged component.

13. The coupling head according to claim 1, wherein said second connection region is disposed on said coupling head housing on a side opposite said end plate and is formed by an end piece that is configured for coupling to a coupling rod.

14. The coupling head according to claim 1, which comprises coupling members received in said coupling head housing.

15. The coupling head according to claim 14, wherein at least one portion of said coupling members is configured in one piece with said coupling head housing.

* * * * *